US008857074B2

(12) United States Patent
Bernon et al.

(10) Patent No.: US 8,857,074 B2
(45) Date of Patent: Oct. 14, 2014

(54) BIO-THERMAL METHOD AND SYSTEM FOR STABILIZING TIMBER

(75) Inventors: Jean-Pierre Bernon, Belleville sur Saone (FR); Alain Dulac, Cublize (FR); Raymond Guyomarc'h, Saint Theodorit (FR)

(73) Assignee: HOLCOP, Boulogne Billancourt (FR)

( * ) Notice: Subject to any disclaimer, the term of this patent is extended or adjusted under 35 U.S.C. 154(b) by 2357 days.

(21) Appl. No.: 11/596,307

(22) PCT Filed: May 13, 2005

(86) PCT No.: PCT/FR2005/001196

§ 371 (c)(1),
(2), (4) Date: Nov. 29, 2007

(87) PCT Pub. No.: WO2005/116551

PCT Pub. Date: Dec. 8, 2005

(65) Prior Publication Data

US 2008/0277027 A1 Nov. 13, 2008

(30) Foreign Application Priority Data

May 13, 2004 (FR) ..... 04 05227

(51) Int. Cl.
*F26B 7/00* (2006.01)
*B27K 5/00* (2006.01)
*B27K 3/02* (2006.01)

(52) U.S. Cl.
CPC ..... *B27K 5/0085* (2013.01); *B27K 3/02* (2013.01)
USPC ..... 34/396; 34/201; 34/225; 110/216; 110/235; 432/37; 427/317

(58) Field of Classification Search
USPC ..... 34/380, 381, 396, 201, 210, 218, 225; 110/216, 228, 235; 432/37; 427/297, 427/317
See application file for complete search history.

(56) References Cited

U.S. PATENT DOCUMENTS

| | | | | | |
|---|---|---|---|---|---|
| 1,366,225 | A | * | 1/1921 | Weiss | 34/396 |
| 1,678,559 | A | * | 7/1928 | Devine | 34/411 |
| 2,490,855 | A | * | 12/1949 | Burns | 236/9 R |
| 2,725,224 | A | * | 11/1955 | Pierce | 432/37 |
| 3,131,034 | A | * | 4/1964 | Marsh | 34/496 |
| 3,319,587 | A | * | 5/1967 | Albertson et al. | 110/223 |
| 3,456,604 | A | * | 7/1969 | Call et al. | 110/215 |
| 3,620,177 | A | * | 11/1971 | Boving | 110/158 |
| 3,627,290 | A | * | 12/1971 | Grieve | 432/48 |
| 3,675,600 | A | * | 7/1972 | Jones | 110/203 |
| 4,017,254 | A | | 4/1977 | Jones | |

(Continued)

FOREIGN PATENT DOCUMENTS

| | | | | |
|---|---|---|---|---|
| EP | 956751 | A1 * | 11/1999 | A01B 1/00 |
| FR | 2720969 | | 12/1995 | |

(Continued)

*Primary Examiner* — Steve M Gravini
(74) *Attorney, Agent, or Firm* — Greer, Burns & Crain, Ltd.

(57) ABSTRACT

A thermal method for stabilizing a load of wood, in particular timber, including: a phase of treatment of the load of wood in a treatment kiln by a gaseous treatment flow; generation of a gaseous treatment flow at high temperature from a heat generator independent of the treatment kiln and recovery of the loaded gaseous flow after treatment.

30 Claims, 3 Drawing Sheets

(56) References Cited

U.S. PATENT DOCUMENTS

| | | | | | |
|---|---|---|---|---|---|
| 4,098,567 | A * | 7/1978 | Hubbert | 432/72 |
| 4,203,229 | A * | 5/1980 | Southworth | 34/538 |
| 4,233,914 | A * | 11/1980 | Schuette et al. | 110/233 |
| 4,240,787 | A * | 12/1980 | Jamaluddin | 432/21 |
| 4,341,167 | A * | 7/1982 | St. John | 110/235 |
| 4,431,405 | A * | 2/1984 | Eatherton | 432/72 |
| 4,450,776 | A * | 5/1984 | Stevenson | 110/233 |
| 4,460,331 | A * | 7/1984 | Robson et al. | 432/72 |
| 4,520,791 | A * | 6/1985 | Chamberlain | 126/518 |
| 4,761,204 | A * | 8/1988 | Kohl et al. | 162/30.1 |
| 4,771,708 | A * | 9/1988 | Douglass, Jr. | 110/233 |
| 5,133,266 | A * | 7/1992 | Cullen | 110/233 |
| 5,228,209 | A * | 7/1993 | Brunner | 34/417 |
| 5,285,738 | A * | 2/1994 | Cullen | 110/233 |
| 5,351,633 | A * | 10/1994 | Buckner | 110/233 |
| 5,433,905 | A * | 7/1995 | Tisch | 264/83 |
| 5,522,327 | A * | 6/1996 | Buckner et al. | 110/233 |
| 5,678,324 | A * | 10/1997 | Viitaniemi et al. | 34/396 |
| 5,815,945 | A * | 10/1998 | Ando | 34/269 |
| 5,819,436 | A * | 10/1998 | Helevirta | 34/408 |
| 5,893,358 | A * | 4/1999 | Whitfield | 126/73 |
| 5,943,789 | A * | 8/1999 | Yamamoto | 34/418 |
| 5,979,074 | A * | 11/1999 | Brunner et al. | 34/396 |
| 6,014,819 | A * | 1/2000 | Elder | 34/396 |
| 6,119,364 | A * | 9/2000 | Elder | 34/212 |
| 6,135,035 | A * | 10/2000 | Masek | 110/228 |
| 6,332,411 | B1 * | 12/2001 | Skrotskaya et al. | 110/297 |
| 6,374,513 | B1 | 4/2002 | Unternhahrer et al. | |
| 6,425,335 | B1 * | 7/2002 | Chen | 110/235 |
| 6,718,653 | B1 * | 4/2004 | Sartorio | 34/396 |
| 6,725,566 | B1 | 4/2004 | Skrotsky et al. | |
| 7,100,303 | B2 * | 9/2006 | Bernon et al. | 34/225 |
| 7,246,452 | B1 * | 7/2007 | Roy | 34/396 |
| 7,370,434 | B2 * | 5/2008 | Duncan | 34/218 |
| 7,621,227 | B2 * | 11/2009 | Sterr | 110/297 |
| 7,754,284 | B2 * | 7/2010 | Roy | 427/254 |
| 7,963,048 | B2 * | 6/2011 | Pollard | 34/396 |

FOREIGN PATENT DOCUMENTS

| | | | | | |
|---|---|---|---|---|---|
| FR | 2861009 | | 4/2005 | | |
| JP | 62130801 | A * | 6/1987 | | B27N 1/00 |
| JP | 01071704 | A * | 3/1989 | | B27N 1/02 |
| JP | 01215501 | A * | 8/1989 | | B27K 3/02 |
| JP | 10238729 | A * | 9/1998 | | F23G 5/033 |
| JP | 10238734 | A * | 9/1998 | | F23G 5/20 |
| JP | 11209763 | A * | 8/1999 | | C10C 5/00 |
| JP | 2000102907 | A * | 4/2000 | | B27K 3/16 |
| JP | 2000320815 | A * | 11/2000 | | F23G 5/00 |
| JP | 2002241762 | A * | 8/2002 | | C10B 53/02 |
| JP | 2004115688 | A * | 4/2004 | | C10J 3/72 |
| JP | 2004323684 | A * | 11/2004 | | C10L 5/44 |
| JP | 2005111374 | A * | 4/2005 | | C02F 11/02 |
| JP | 2006077198 | A * | 3/2006 | | |
| JP | 2007216163 | A * | 8/2007 | | |
| JP | 2008037909 | A * | 2/2008 | | |
| JP | 2008272545 | A * | 11/2008 | | |
| JP | 2010043269 | A * | 2/2010 | | |
| WO | WO 9814404 | A1 * | 4/1998 | | C02F 1/28 |
| WO | WO 01/14044 | A2 | 3/2001 | | |

* cited by examiner

BIO-THERMAL METHOD AND SYSTEM FOR STABILIZING TIMBER

BACKGROUND

The present invention relates to a method for stabilizing timbers. It also relates to a system for implementing this method. By timber is meant, in this case, wood intended for use in the secondary timber processing sectors, in particular for industry, building, joinery, or for urban, industrial, public and domestic external and internal construction.

Passing wood through a flame to heat it to its ignition limit in order to render it rot-proof, and even impervious to attack by its natural predators, is an age-old practice. It is in order to homogenize these effects on much larger quantities of wood that research is being carried out into the heating of wood.

The stabilization methods currently being developed all have their characteristics. There can in particular be mentioned the high-temperature wood-treatment method disclosed in the document FR 2757097. This treatment method utilizes a generation of gaseous treatment flows introduced into the kiln for treating the load of wood.

With current methods it is too often difficult to achieve the objective which is to raise the temperature such that it is homogeneous as far as the core of a mass of wood, to the point of making this wood stable and rot-proof without any added chemical agent. This temperature point is approximately 230° C. It is essential that it is reached and maintained with no risk to the load or to the system, given that the timber's self-ignition temperature is approximately 120/160° C.

The purpose of the present invention is to propose a method for stabilizing timber, which provides guarantees of safety and treatment in complete harmony with the environment and ecology.

SUMMARY

This objective is achieved with a bio-thermal method for stabilizing a load of wood, in particular timber, comprising:

- a phase of treatment of the load of wood in a treatment kiln by a gaseous treatment flow,
- generation of a gaseous treatment flow at high temperature from heat generation means independent of said treatment kiln, and
- recovery of the loaded gaseous flow after treatment.

The independence of the heat generation means with respect to the treatment kiln contributes significantly to making the wood-treatment method according to the invention safe. Moreover, this method can be implemented simultaneously with several treatment kilns while using only a single gaseous treatment flow generation.

The method according to the invention can advantageously comprise a recycling of the loaded gaseous flow in order to recover gas capable of being used in the gaseous treatment flow. The thermal gaseous flow is preferably a flow comprising carbon dioxide $CO_2$. The gas used for the gaseous treatment flow is advantageously obtained from a combustion gas which is output from the heat generation means.

In a particular embodiment, the method according to the invention comprises a preliminary phase of condensing elements contained in the combustion gas, in order to recover a residual gas containing carbon dioxide.

The residual gas can pass through a heat exchanger in order to reach the treatment temperature, and is then reintroduced into the treatment cycle, in order to be used in a wood-drying phase. Moreover compression of the residual gas is provided, in order to condense and recover the carbon dioxide in liquid phase.

The method according to the invention can moreover advantageously comprise, at the end of the treatment phase, a phase of lowering the temperature of the load of wood during which the treatment gas is introduced into the treatment volume at a progressively lower temperature.

According to another aspect of the invention, a bio-thermal system is proposed for stabilizing a load of wood, in particular of timber, implementing the method according to the invention, comprising:

- treatment kiln means provided for receiving the load of wood and for subjecting said load to the gaseous treatment flow,
- means for generating a gaseous treatment flow at high temperature, independent of said treatment kiln means, and
- gas exchange means, provided for producing a connection between the heat generation means and the treatment kiln means.

The heat generation means comprise for example at least one grate furnace and a heat exchanger in which the energy produced by the combustion of a fuel with an oxidant is recovered.

In a particular form of implementation, the stabilization system according to the invention moreover comprises means for reintroducing the residual gas which is output from the heat generation means into a treatment cycle, these reintroduction means comprising means for condensing the steam $H_2O$ present in said residual gas, and means for passing said residual gas through the heat exchanger where said residual gas reaches the temperature of the treatment in progress.

This system can moreover comprise means for compressing the residual gas, so as to condense and recover the carbon dioxide in liquid phase, as well as means for concentrating the carbon dioxide in the residual gas.

In a practical embodiment example of the stabilization system according to the invention, the wood treatment means comprise at least one kiln module comprising two removable end partitions in order to allow a transfer of loads of wood to be treated, through one and/or the other of said two ends.

The kiln module can be substantially in the form of a parallelepiped and comprise fixed vertical side partitions comprising double walls in order to provide a space in which the treatment gas and the gas extracted after treatment are conveyed. The external walls of the vertical side partitions are thermally insulated.

Advantageously there can be provided an assembly of a plurality of kiln modules, characterized in that intermediate mobile end partitions are arranged so that they can be removed, the removable end partitions of the assembly of modules being kept closed during the treatment. Intermediate mobile partitions can be installed in order to define several distinct treatment zones comprising for example a drying zone and a high temperature stabilization zone.

The kiln module preferably comprises a ceiling with double walls between which a treatment-gas distribution system is arranged. This gas distribution system comprises means for receiving hot treatment gas originating from the heat generation means and means for extracting this gas after passing inside the kiln module and treatment of the load of wood. The internal wall of the ceiling can be adjustable in height so as to compensate for a variable height in the load of wood to be stabilized.

The system according to the invention can also comprise means for delivering the gas extracted from the kiln module after treatment towards reactor means within heat generation means, in order to be purified there, as well as exhaust fan means for maintaining the kiln module treatment volume under low pressure.

There can also be provided a pressure drop compensation system installed on a treatment gas duct between the heat generation means and the means for treating the load of wood.

The gas distribution system comprises for example means for alternating the extraction of the loaded gases through one and the other of the side walls of the kiln module. These alternation means comprises a four-way mechanism arranged at the junction of the connections of the duct supplying the hot gas, the duct for extracting the loaded gas after treatment, and ducts connected to the fixed vertical walls of the kiln module.

The stabilization method according to the invention uses a completely neutral gas, at the temperatures and pressures of the method, which makes it possible to raise the temperature of the wood well beyond its self-ignition limits. This gas is advantageously carbon dioxide $CO_2$. The $CO_2$ is the final phase of carbon combustion, and is therefore non-flammable.

The carbon dioxide is used in the method as:

- heat vector; the temperature of the $CO_2$ being raised to the right degree for the programme in progress, in the heat exchanger of the generator,
- neutralizing agent, no ignition in a space occupied by this gas being possible, which contributes to the safety of the treatment volume of the method during the stabilization of the timber,
- means for preventing any entry of air through the sensitive zones of the stabilization system, therefore oxidant oxygen which is indispensable for any combustion.

The carbon dioxide $CO_2$ used in the method according to the invention has advantageously originated from the heat production method utilized in the heat generator.

According to yet another aspect of the invention, a wood is proposed, in particular a timber, having the characteristics of a wood which has been subjected to the stabilization method according to the invention.

BRIEF DESCRIPTION OF THE DRAWINGS

Other advantages and characteristics of the invention will become apparent on examining the detailed description of an embodiment which is in no way limitative, and the attached drawings in which.

DETAILED DESCRIPTION OF THE PREFERRED EMBODIMENT

A description will now be given, with reference to the abovementioned figures, of an embodiment example of a stabilization system according to the invention, at the same time as the method implemented in this method.

Figure 1:
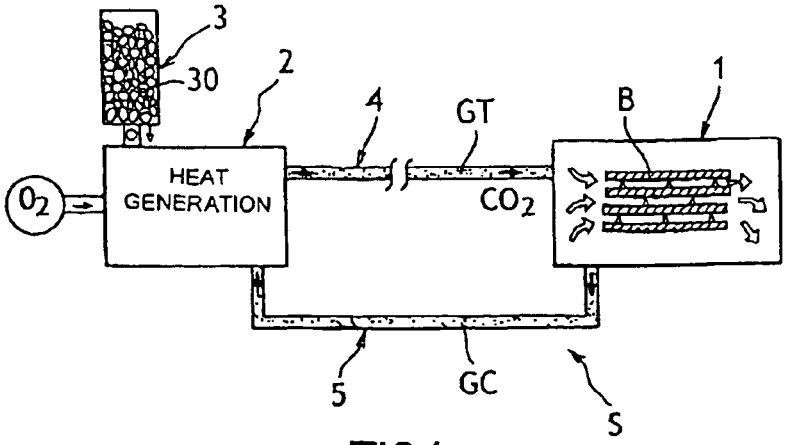
FIG. 1 is a block diagram of a stabilization system according to the invention.

The stabilization system S comprises, with reference to FIG. 1, a heat generator 2 and one or more high-temperature treatment kilns 1. The heat generator 2 and the treatment kilns 1 are independent and can be installed at a distance from one another, and they are connected via a two-way flow and reflux gaseous exchange system. The whole of the stabilization system according to the invention is for example controlled and managed by a metrology system and a computer program with digital controls.

Figure 4:
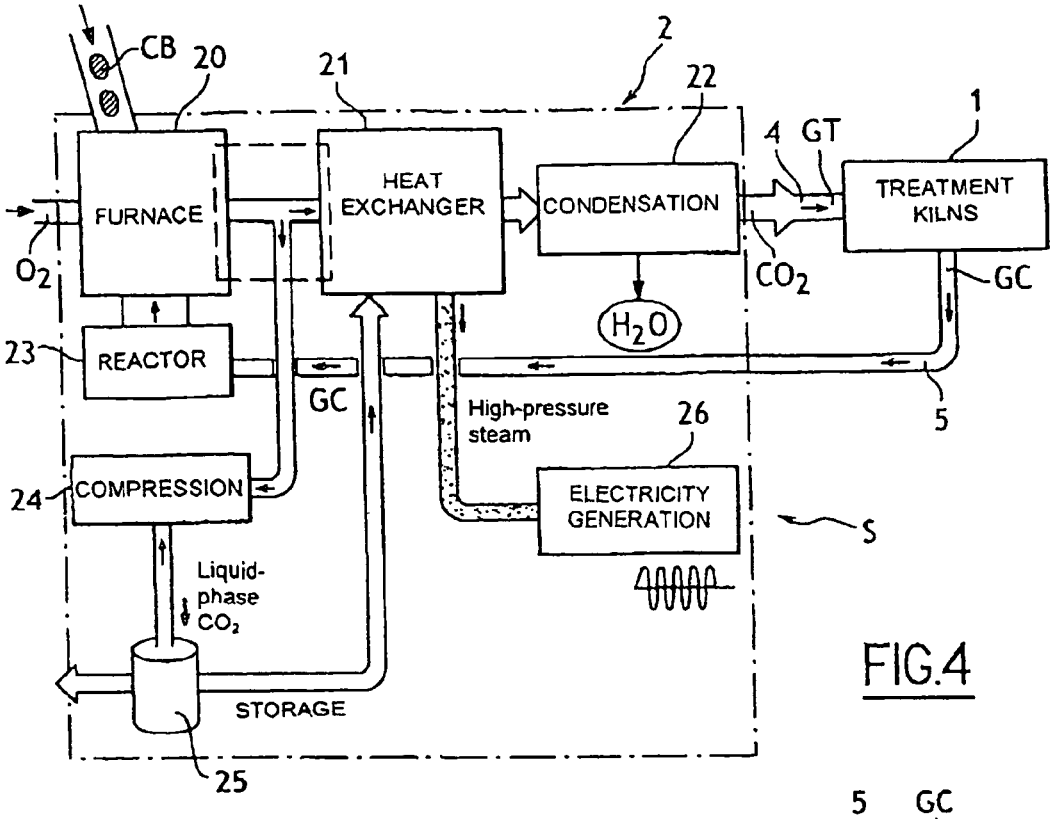
FIG. 4 illustrates diagrammatically the structure of a heat generation system utilized in a stabilization system according to the invention.
Figure 5A:
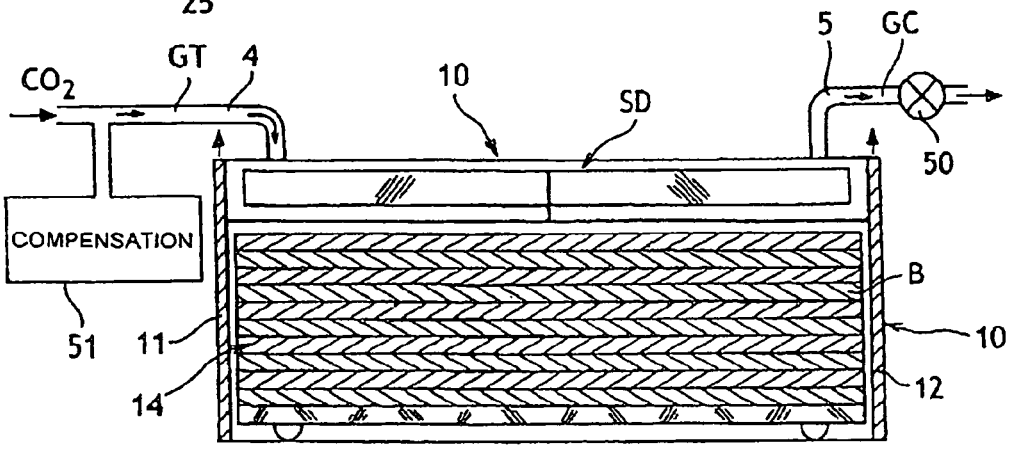
FIGS. 5A and 5B are respectively a longitudinal section and a top view of a kiln module.
Figure 5B:
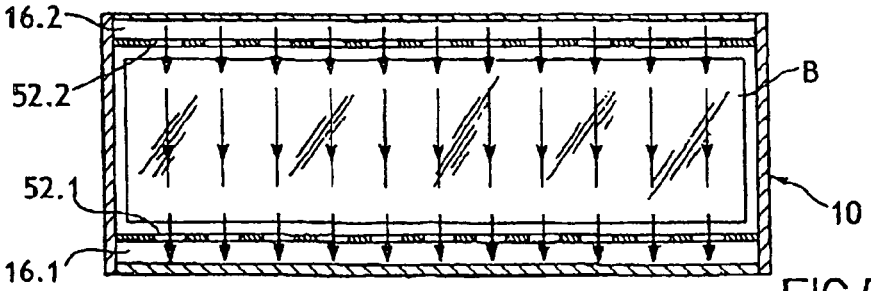
Figure 6A:
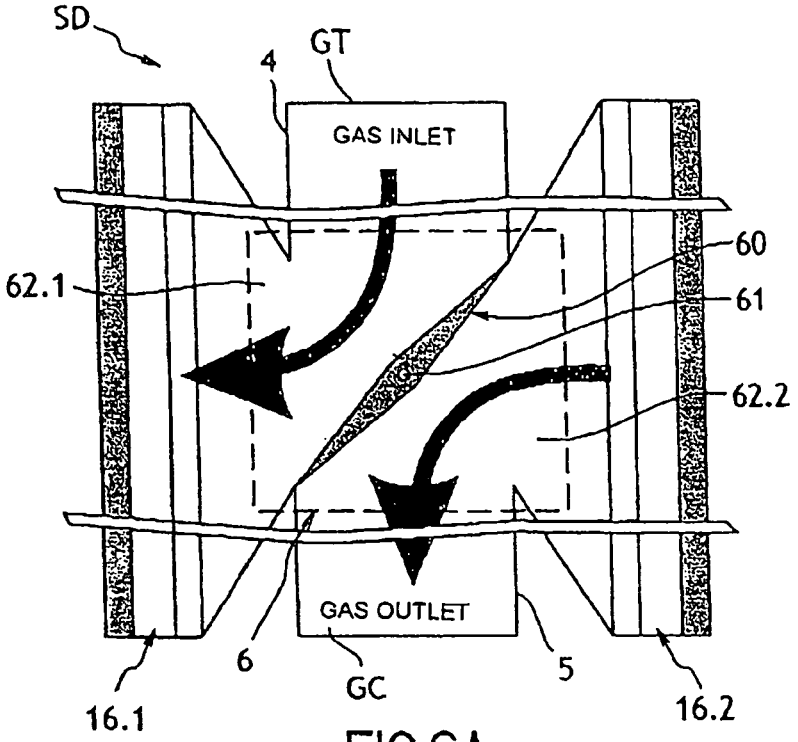
FIGS. 6A and 6B represent diagrammatically the two states characteristic of the distribution system equipping a kiln module in a stabilization system according to the invention.
Figure 6B:
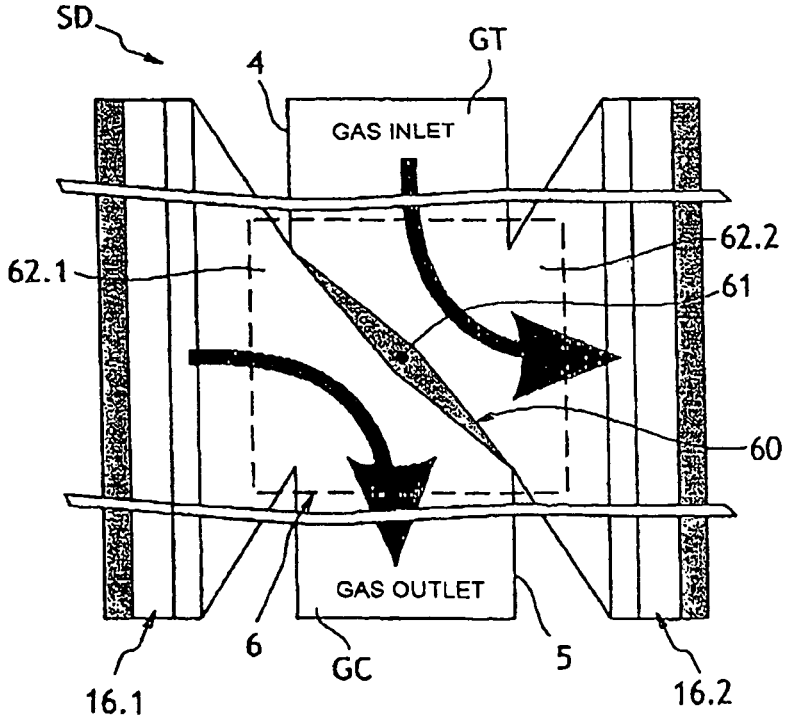

The heat generator 2 is a system, with reference to FIG. 4, comprising one or more grate furnaces 20 and a heat exchanger 21 where all the energy produced by the combustion is recovered. This recovery allows the condensation 22 of all the elements contained in the combustion gas (which are recovered and recycled) including the condensation of $H_2O$ which, in the method, is condensed between 80 and 60° C. After the combustion gases have had elements other than $CO_2$ and those not condensable at this temperature removed, the $CO_2$ is recovered at the outlet of the generator 2.

Depending on the combustion principle applied, the concentration of $CO_2$ in the residual gas is more or less high. If the combustion is carried out under oxidant (or combustive) air, the residual gas comprises a large percentage of nitrogen: approximately 4 volumes of nitrogen to 1 volume of $CO_2$. If the combustion is carried out under $O_2$, the residual gas comprises more than 95% $CO_2$.

According to the type of installation and its function the oxidant (or combustive) can be ambient air as it is, air enriched with $O_2$, at a more or less high percentage, industrial $O_2$, or also the three subsequent combustion methods, during a cycle, as a function of the rise in temperature and the guarantee of safety.

Given the chosen combustion method, the thermal yield is different: from a minimum yield with oxidant air to the maximum yield with industrial $O_2$. It is the combustion method which determines the $CO_2$ recovery procedure.

If the residual gas after the condensation of $H_2O$ comprises more than 90% $CO_2$, it is recovered as it is in order to:

- be reintroduced into the treatment cycle after passing through the heat exchanger 21 where it reaches the temperature of the treatment in progress (controlled by the electronic program). This case is used for the wood-drying phase during which there is no risk of self-ignition;
- be compressed to 25 Bars, this operation making it possible to condense and recover the $CO_2$ in liquid phase. The residual gas now being only nitrogen and elements which are neither polluted nor polluting, it can be discharged to the outside. By this method, the condensed $CO_2$ has all the qualities required by the method;
- be cooled down by a cooling system, at low pressure and at the $CO_2$ condensation temperature of approximately minus one hundred degrees (−100° C.) By this method the condensed $CO_2$ has all the qualities required by the method and for being marketed for any useful purpose.

When the residual gas after the condensation of $H_2O$ comprises less than 30% $CO_2$ the two methods for concentrating the $CO_2$ must be implemented. The gaseous residue is recycled in the generator 2 during the treatment cycle. The $CO_2$ concentration method is used until the quantity collected is sufficient for the high-temperature phase. The liquid $CO_2$ is stored 25 in order to be used in the method. The $CO_2$ store increases as the treatment cycles proceed, and there is therefore an economic benefit to draw off the surplus of marketable quality.

In the grate furnace or furnaces 20, "vegetable biomasses" are burned, in all solid fuel forms CB (with dimensions greater than sawdust and crushed materials). These are all so-called "energy wood" forms (logs, billets, wood chips, slabs, edgings, reconstituted briquettes which are stable in combustion, granules, etc.).

The solid fuel is preferably densified biomass [Bio-D]® which, due to its densification method, is a carbon concentrate (85% instead of 50% for the "energy" biomass) and therefore an energy concentrate. The densified biomass [Bio-D]® makes it possible to achieve a greater yield of $CO_2$ during a cycle.

The accumulation of $CO_2$ recovered allows utilization in various additional methods. The withdrawal of its atmospheric equivalent in greenhouse gas, in each application and each use, is an enormous gain for the ecosystem. The carbon dioxide $CO_2$ is produced once and used several times in methods which would have produced it in another fashion.

The oxidant (or the combustive) used is preferably industrial oxygen, especially if the system must be used in a complex with energy co-generation. The thermal ratio is then substantially greater. The oxidant can also be "atmospheric" air enriched or not enriched, in installations where only the stabilization of the wood is sought.

The energy recovered in the exchanger 21 makes it possible to reheat the $CO_2$ intended to be used for the wood treatment, it is also used in order to produce steam at a high pressure for the co-generation of electricity 26. This electricity is used for the stabilization method according to the invention, which renders it autonomous.

If the stabilization method according to the invention is utilized in order also to achieve the co-combustion of waste, the energy produced is greater than the needs of the system. The excess co-generated energy can be marketed and used in additional facilities of the complex.

Figure 2A:
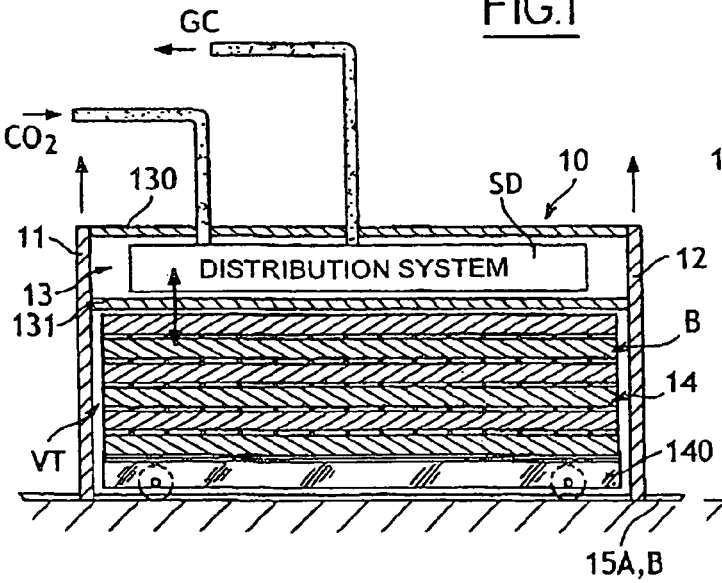
FIGS. 2A and 2B are respectively a longitudinal section and a cross-section of a kiln module utilized in a stabilization system according to the invention.
Figure 2B:
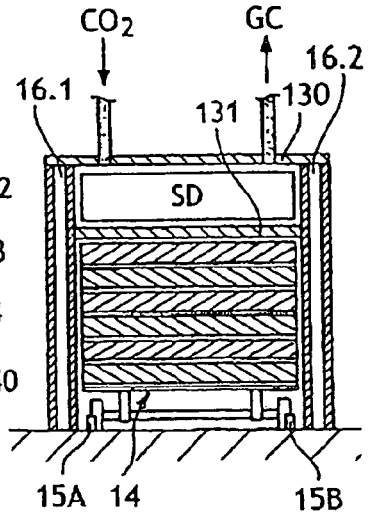

The wood treatment kiln 10 is for example produced, with reference to FIGS. 2A and 2B, in the form of a rectangular parallelepiped-shaped module 6 meters long for an internal technical section of l×h=150×220 cm, the two ends 11, 12 of which are removable in order to allow the transfer of the treated materials through the two ends.

Figure 3:
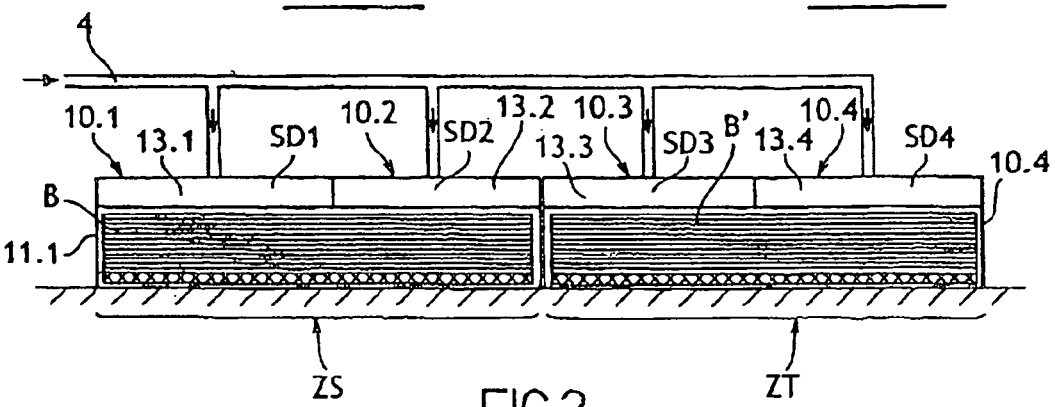
FIG. 3 illustrates an assembly of kiln modules as represented in FIG. 2.

This characteristic makes possible, with reference to FIG. 3, the assembly of several kiln modules 10.1, 10.2, 10.3, 10.4 in order to produce treatment units of a customized length. The fixed vertical partitions 16.1, 16.2 of the module 10 have double walls in order to provide a space in which the treatment gas GT and the loaded gas GC extracted after treatment are conveyed. The external wall is preferably insulated in order to control heat losses.

The ends 11, 12 are mobile and removable, and they close the treatment volume VT when the load of wood B has entered. When several kiln modules 10.1, 10.2, 10.3, 10.4 are assembled, it is the ends 11.1, 10.4 of the assembly which are closed, as illustrated by FIG. 3. In this embodiment, intermediate mobile partitions can be installed in order to allow two distinct treatment zones ZS, ZT, for example: drying on one side, high-temperature stabilization on the other.

Whether for one kiln module or several assembled modules 10.1, 10.2, 10.3, 10.4, a single generator 2 with its specific peripherals will supply the treatment gas GT and the energy necessary to the system.

The ceiling 13 of the kiln module 10; 10.1, 10.2, 10.3, 10.4 also has double walls 130, 131 between which the gas distribution system SD is organized; SD1, SD2, SD3, SD4. This distribution system is designed in order to receive the hot gas GT originating from the heat generator 2 and extract this loaded gas GC after it has passed through the treatment technical volume VT. The low/internal wall, which relates to the technical treatment volume, is mobile in order to be adjusted to a suitable height, to compensate for variable heights of the load of wood B to be stabilized.

The floor of the kiln module 10 is equipped with rails 15A, 15B, with reference to FIGS. 2A and 2B, for rolling the carriage 14, carrying the load of wood B to be stabilized. In order to avoid corridors, which would create disturbances in the distribution of the hot gas in the load of wood B, the carriage 14 is equipped with deflectors 140 on either side in order to cancel out the rolling technical height.

The gas extracted GC is delivered to the reactor 23 in the heat generator 2 in order to be purified before its reuse. This extracted gas is then loaded with gasified elements during the raising of the temperature of the wood to be treated. The $CO_2$ gas used for the treatment of the wood is thus continuously recycled. It is recovered at the outlet of the generator 2 with the $CO_2$ produced by the combustion methods in the reactor (combustion of the solid fuel and of the elements of the wood which have been gasified during the treatment).

The gas extracted after treatment of the wood comprises $CO_2$ introduced from the steam originating from the wood, and combustible volatile molecules, gasified during the raising of the temperature of the load of wood.

The combustible gas parts will be reduced to their native elements in the thermal reactor, where all their available energy will be produced. The steam is purified by passing through the solid fuel reactor 23, it is condensed to pure water after recovery of the thermal energy. The recovered thermal energy makes it possible to produce a quality of steam which will be used for the co-generation of electricity 26.

The residual heat, after co-generation, is used for the stabilization method. The treatment gas being permanently recycled, this residual heat is recovered. There is a surplus of heat during the recycling methods, this heat can be utilized in the additional facilities of a complex, for example:

- for dehydrating sludges from treatment plants in a closed method where the $CO_2$ also has an active and neutralizing role,
- for providing electricity and heat to an industry, a community etc.

The treatment volume VT of the kiln module 10 is maintained under low pressure by an exhaust fan 50 independent of the kiln. It is situated on the outside of the duct 5 for extraction of the gases from the kiln module 10 and delivery to the heat generator 2. It is this extraction of the loaded gases GC which creates the low pressure in the treatment volume VT of the kiln module 10. The loaded gas GC is delivered to the reactor 23 in the generator 2 which purifies this gas in a permanent recycling method. The $CO_2$ is recovered at the outlet of the generator 2 by the methods described above. The recovered $CO_2$ is in liquid phase, its temperature lies between −85 and −100° C.

The gaseous/liquid phase change requires a significant amount of energy. This same amount of energy is restored during the liquid/gaseous phase change, it is during this phase change that the condensation of the steam contained in the extracted gas takes place.

The $CO_2$, which must be introduced for the treatment, attains its appropriate heat in the heat exchanger 21 as a function of the temperature programmed by the treatment cycle. The $CO_2$ is thus moderated and suitable for a new treatment cycle, it is sucked in by the low pressure created in the technical volume VT of the kiln module 10, via the gas distribution system SD and so on. A pressure drop compensation system, connected at a significant distance between the generator 2 and the kiln module 10, can be installed on the treatment gas GT duct 4.

The heat generator 2, the kiln module 1 and the gas ducts 4, 5, connecting these two units, are efficiently thermally insulated, in order to reduce the energy losses and make the equipment safe to approach.

The continuous production of $CO_2$ accumulates with the recycled $CO_2$, which induces a superabundance of this gas. $CO_2$ is a strategically important gas in the developing economy, having the properties of a neutral gas for the preservation of certain foodstuffs in the agri-food industry, and as a substitution gas for prohibited refrigerant gases, and as a raw material in technological materials.

With reference to FIGS. 2A, 2B, 5A, 5B, and 6A, 6B, the gas distribution system SD, situated in the double wall of the ceiling 13 of the kiln module 10, is designed in order to alternate the extraction of the loaded gases GC, both through the left-hand wall 16.1 and through the right-hand wall 16.2. Consequently, this ensures the alternation of entry of the hot treatment gases GT through the opposite wall. The effects of the hot treatment gas GT on the mass of timber B to be stabilized are thus uniformly distributed, the temperature of this mass thus rising very homogeneously. In order to achieve this alternation, a four-way mechanism 6 is positioned at the junction of the connections:

- of the duct 4 supplying the hot gas GT for the stabilization,
- of the duct 5 extracting the loaded gas GC and,
- of the ducts 62.1, 62.2 connected to the fixed vertical walls 16.1, 16.2 of the kiln module 10.

This mechanism 6 is automatically controlled by the electronic programme for carrying out the treatment. It transfers and alternates the flow/extraction from the one to the other of the vertical walls 16.1, 16.2. This four-way mechanism 6 is produced for example in the form of a parallelepiped the four vertical faces of which are connected facing:

- the right- and left-hand walls 16.2, 16.1 of the kiln module 10,
- the entry 4 of the hot treatment gases GT originating from the heat generator 2, as well as the extraction duct 5 for the loaded gases GC which are delivered to the heat generator 2.

This mechanism 6 comprises a mobile wall 60, centred on its vertical axis 61, which hides the diagonals of the parallelepiped by pivoting about the axis 61. This action alternates the connections of entering and exiting gases to the right-hand 16.2 or left-hand walls 16.1.

In the internal faces of the fixed vertical walls 16.1, 16.2 of the kiln module 10, vertical inlets 52.1, 52.2 are arranged so that the transfers of the flow/extraction gases can take place in the treatment volume VT. These inlets are provided with mobile deflectors, which can be mechanized to provide good distribution of the treatment flow. An upper part of these deflectors is made up of elements which can be closed independently, to make it possible to adjust the height of the ceiling in the treatment volume VT.

The adjustment of the flow of treatment gas GT is carried out by varying the low pressure in the treatment volume VT of the kiln module 10 by varying the power of the extraction motor 50. The object of this heat transfer method is to make the aerodynamics of the gases more fluid and thus to avoid overheating in the zones.

The constant low pressure guarantees that a gas concentration inside the kiln module is impossible. Means of injecting steam into the flow of treatment gas are arranged in order to control the drying of the wood under the best technical conditions. In fact, too-rapid drying would have the consequence of causing physical damage to the treated wood.

The deflectors on the fixed vertical walls can completely block off the inlets, this makes it possible to provide neutral zones when the load of wood to be treated does not occupy all the technical space in the kiln module. In this case, a removable and adjustable partition separates the neutral zone from the active zone in order to save the energy used and reduce the cost of the treatment.

The kiln module 10 can also be arranged so that the mobile end walls can also be shifted in horizontal translation so as to be placed in close proximity to the ends of the load of wood B. This minimizes the treatment volume VT for a given load of wood, which improves the effectiveness of the stabilization method and energy saving.

When the stabilization is carried out, the load of wood B is at too high a temperature to be removed. This temperature must be reduced so as not to risk self-ignition in air and to ensure that it is safe to handle the load B. In order to achieve this reduction in temperature the cycle is continued until the load can be removed in complete safety. The $CO_2$ is introduced at a progressively lower temperature under control of the program, so as not to create thermal shocks detrimental to the load of wood. The condition of recovery of the $CO_2$ in liquid phase makes it possible to lower the temperature of the load of wood very significantly.

The energy which is produced by the heat generator 2, in order to be transferred to the $CO_2$ treatment gas (which transfers part of it to the wood to be treated) is largely recovered by the generator 2, since the treatment gas GT is continuously recycled and therefore the energy that it conveys is also recycled.

The gas used for cooling down the load of wood B, before removing it from the kiln module 10, is also recycled in the generator 2. There is therefore a large quantity of energy available during and at the end of the treatment cycle. This energy can be used in related methods, in particular for drying the wood, energy which can be used in the stabilization method.

The operation of the system can be prolonged and made more profitable by using certain waste as co-fuels with [Bio-D]®, for example, Non-Reusable Used Tyres (NRUT) or polluted timbers, which are subject to a disposal charge tax and which makes the operation more profitable.

This operation of the system allows integration into a synergetic assembly where:

- the initial energy and the thermal base is plant biomass, i.e. a source of renewable energy,
- additional energy is provided by one or more types of combustible waste the production of which requires an energy supply. The "co-combustible" waste therefore contains residual production energy which is completely restored in the method. This is therefore also a source of renewable energy,
- the accumulation of energy produced can be used in additional systems having their own profitability and which will buy this clean energy. For example the dehydration of sludge from urban and industrial treatment plants in order to make the dry materials recyclable as organic fertilizer if they are compatible, or as co-fuel which will realize all of its energy potential in the system. In this example, the disposal of the waste is subjected to a charge which contributes to the economic benefit of the system.

Of course, the invention is not limited to the examples which have just been described and numerous adjustments can be made to these examples without exceeding the scope of the invention.

The invention claimed is:

1. A thermal method for stabilizing a load of wood, in particular timber, comprising:

treating the load of wood in a treatment kiln by a gaseous treatment flow including a completely neutral gas;

generating a gaseous treatment flow at high temperature from a heat generator independent of said treatment kiln; and recovering the loaded gaseous flow after treatment of the load of wood.

2. The method according to claim 1, characterized in that it moreover comprises a recycling of the loaded gaseous flow in order to recover gas capable of being used in the gaseous treatment flow.

3. The method according to claim 1, characterized in that it moreover comprises combustion of combustible volatile bodies, gasified during the treatment phase of the load of wood and recovered with the loaded gaseous flow.

4. The method according to claim 3, characterized in that the combustion of the recovered combustible volatile bodies contributes towards the generation of the gaseous treatment flow.

5. The method according to claim 1, characterized in that the gaseous treatment flow is a flow comprising carbon dioxide $CO_2$.

6. The method according to claim 1, characterized in that the gas used for the gaseous treatment flow is obtained from a combustion gas which is output from the heat generator.

7. The method according to claim 5, characterized in that it comprises a preliminary phase of condensation of elements contained in the combustion gas, in order to recover a residual gas containing carbon dioxide.

8. The method according to claim 7, characterized in that the residual gas passes through a heat exchanger in order to reach the treatment temperature there, and is then reintroduced into the treatment cycle, in order to be used in a wood-drying phase.

9. The method according to claim 7, characterized in that it moreover comprises a compression of the residual gas, in order to condense and recover the carbon dioxide in liquid phase.

10. The method according to claim 9, characterized in that it moreover comprises a preliminary phase of concentration of the carbon dioxide from the residual gas.

11. The method according to claim 1, characterized in that it moreover comprises, at the end of the treatment phase, a phase of lowering the temperature of the load of wood during which the treatment gas is introduced into the treatment volume at a progressively lower temperature.

12. Wood, in particular timber, having the characteristics of a wood which has been subjected to the stabilization method according to claim 1.

13. A thermal system for stabilizing a load of wood, in particular of timber, comprising:

treatment kiln means provided for receiving the load of wood and for subjecting said load to the gaseous treatment flow including a completely neutral gas;

means for generating a gaseous treatment flow at high temperature using a biomass fuel, independent of said treatment kiln means; and gas exchange means provided for producing a connection between the heat generation means and the treatment kiln means.

14. The system according to claim 13, characterized in that the heat generation means comprise means for combustion of the combustible volatile bodies, gasified during the treatment phase of the load of wood and recovered with the loaded gaseous flow.

15. The system according to claim 13, characterized in that the gas used for the gaseous treatment flow is a neutral gas under predetermined temperature and pressure conditions, in particular carbon dioxide ($CO_2$).

16. The system according to claim 15, characterized in that it moreover comprises means for recovering the carbon dioxide from residual gases leaving the heat generation means.

17. The system according to claim 13, characterized in that the heat generation means comprise at least one grate furnace and a heat exchanger in which the energy produced by the combustion of a fuel with an oxidant is recovered.

18. The system according to claim 16, characterized in that it moreover comprises means for compressing the residual gas, so as to condense and recover the carbon dioxide in liquid phase.

19. The system according to claim 13, characterized in that the fuel used in the heat generation means comprises a solid fuel.

20. The system according to claim 19, characterized in that the solid fuel comprises densified biomass.

21. The system according to claim 13, characterized in that the wood-treatment means comprise at least one kiln module comprising two removable end partitions in order to allow a transfer of loads of wood to be treated, through one and/or the other of said two ends.

22. The system according to claim 21, comprising an assembly of a plurality of kiln modules, characterized in that intermediate mobile end partitions are arranged so that they can be removed, the removable end partitions of the assembly of modules being kept closed during the treatment.

23. The system according to claim 22, characterized in that the distinct treatment zones comprise a drying zone and a high-temperature stabilization zone.

24. The system according to claim 21, characterized in that the kiln module comprises a ceiling with double walls between which a treatment gas distribution system is arranged, this distribution system comprising means for receiving hot treatment gas originating from the heat generation means and means for extracting this gas after passing inside the kiln module and treatment of the load of wood.

25. The system according to claim 21, characterized in that it moreover comprises means for delivering the loaded gas extracted from the kiln module after treatment to reactor means within heat generation means, in order to be purified there.

26. The system according to claim 21, characterized in that it moreover comprises exhaust fan means for maintaining the kiln module treatment volume under low pressure.

27. The system according to claim 21, characterized in that the gas distribution system comprises means for alternating the extraction of the loaded gases through one and the other of the side walls of the kiln module.

28. The system according to claim 21, characterized in that the fixed vertical walls of the kiln module are provided, on their internal walls, with vertical inlets provided in order to carry out transfers of the treatment gas and the loaded gas to be extracted, in the treatment volume.

29. The system according to claim 28, characterized in that the inlets are provided with mobile deflectors for distributing the treatment flow inside the treatment volume, these deflectors making it possible to block off said inlets in order to reduce the treatment volume when the load of wood does not occupy the whole length of the kiln module.

30. The system according to claim 13, characterized in that it moreover comprises means for injecting steam into the treatment gas flow inside the treatment volume.

* * * * *